US007866743B1

(12) United States Patent
Russell et al.

(10) Patent No.: US 7,866,743 B1
(45) Date of Patent: Jan. 11, 2011

(54) TEMPERATURE ADJUSTABLE CHAIR

(76) Inventors: Randy P. Russell, 744 Rue Calais, Mandeville, LA (US) 70471; Gary V. Triola, 71097 Highway 41, Pearl River, LA (US) 70452

( * ) Notice: Subject to any disclaimer, the term of this patent is extended or adjusted under 35 U.S.C. 154(b) by 0 days.

(21) Appl. No.: 12/398,366

(22) Filed: Mar. 5, 2009

Related U.S. Application Data

(60) Provisional application No. 61/034,354, filed on Mar. 6, 2008.

(51) Int. Cl.
*A47C 7/74* (2006.01)

(52) U.S. Cl. ..... 297/180.12; 297/180.1; 297/180.13; 297/180.14

(58) Field of Classification Search ..... 297/180.1, 297/180.12, 180.13, 180.14
See application file for complete search history.

(56) References Cited

U.S. PATENT DOCUMENTS

| | | | | | |
|---|---|---|---|---|---|
| 1,526,132 | A * | 2/1925 | Gilger | ..... | 297/180.12 X |
| 2,587,731 | A * | 3/1952 | Irving | ..... | 297/180.12 X |
| 2,782,834 | A | 2/1957 | Vigo | | |
| 3,621,192 | A * | 11/1971 | Pohler | ..... | 297/180.12 X |
| 3,638,255 | A * | 2/1972 | Sterrett | ..... | 297/180.1 X |
| 3,648,469 | A * | 3/1972 | Chapman | ..... | 297/180.12 X |
| 3,885,259 | A * | 5/1975 | Cheong | ..... | 297/180.1 X |
| 4,141,585 | A | 2/1979 | Blackman | | |
| 4,969,684 | A * | 11/1990 | Zarotti | ..... | 297/180.12 |
| 5,335,381 | A | 8/1994 | Chang | | |
| 5,613,730 | A * | 3/1997 | Buie et al. | ..... | 297/180.12 |
| 5,839,788 | A * | 11/1998 | Orr, III | ..... | 297/180.12 X |
| 6,302,094 | B1 | 10/2001 | Wehrly et al. | | |
| 6,786,273 | B2 * | 9/2004 | Ichigaya | ..... | 297/180.14 X |
| 7,059,671 | B1 | 6/2006 | Coggins | | |
| 7,117,611 | B2 | 10/2006 | Park et al. | | |
| 2004/0075311 | A1 * | 4/2004 | Linder | ..... | 297/180.1 X |
| 2005/0200166 | A1 * | 9/2005 | Noh | ..... | 297/180.14 |
| 2006/0175877 | A1 * | 8/2006 | Alionte et al. | ..... | 297/180.14 |
| 2009/0072594 | A1 * | 3/2009 | Korytowski | ..... | 297/180.12 |

* cited by examiner

*Primary Examiner*—Rodney B White
(74) *Attorney, Agent, or Firm*—Kenneth L. Tolar

(57) ABSTRACT

A temperature adjustable chair includes a seat portion with a backrest portion vertically extending therefrom. The seat portion is superimposed on a plurality of support legs that suspend the chair above an underlying surface. Adjacent each of two sides of the seat portion is an armrest. Imbedded within both the backrest portion and the seat portion is a thermoelectric cooler for selectively generating or removing heat. The cooler is regulated with a control panel positioned on one of the armrests.

12 Claims, 1 Drawing Sheet

TEMPERATURE ADJUSTABLE CHAIR

CROSS REFERENCE TO RELATED APPLICATIONS

This application is entitled to the benefit of provisional application No. 61/034,354 filed on Mar. 6, 2008, the specification of which is incorporated herein by reference.

BACKGROUND OF THE INVENTION

The present invention relates to a chair having a temperature control means that can either cool or heat a person seated within the chair.

DESCRIPTION OF THE PRIOR ART

People engaging in various outdoor activities such as hunting, fishing, tailgating or attending sporting events often sit outdoors in portable chairs for prolonged durations. Sitting outdoors during colder months can be extremely uncomfortable; though additional layers of clothing or blankets are sometime used, they are marginally effective and are cumbersome to transport. Conversely, when a person is seated outdoors during warmer months, little can be done to minimize the discomfort. Accordingly, there is currently a need for a chair having both a cooling and a heating means that can be adjusted according to ambient conditions.

A review of the prior art reveals several heated or cooled outdoor chairs. For example, U.S. Pat. No. 6,302,094 issued to Wehrly et al. discloses an indoor/outdoor heating and cooling system including a heat exchanging coil immersed in a heated pod. Flexible tubing is connected to the coil for transmitting the fluid through chairs, sleeping bags and similar items.

U.S. Pat. No. 4,141,585 issued to Blackman discloses a cooling chair having a plurality of vents in communication with a coolant (i.e., dry ice) storage chamber. An electric fan disperses the coolant through the vents.

U.S. Pat. No. 7,059,671 issued to Coggins discloses a chair having fans that disperse air through a series of jet spouts in the chair framework. U.S. Pat. No. 5,335,381 issued to Chang discloses a heated bed.

U.S. Pat. No. 7,117,611 issued to Park discloses a heated chair for drying the body and feet.

U.S. Pat. No. 2,782,834 issued to Vigo discloses an air-conditioned chair.

Although some heated and cooled chairs exist, they have several disadvantages. The cooled chairs in the prior art require a fan or pump to circulate cooling air or fluid using. At least one chair employs an air conditioner compressor to produce cooled air. Accordingly, the devices are expensive and difficult to construct; furthermore, due to the numerous required components, the devices are also bulky, heavy and cumbersome to transport. Similarly, the heated chairs described above are also formed of numerous bulky components, such as heaters, blowers and piping. More importantly, none of the prior art devices include a temperature adjustment means that can both heat and cool the chair according to ambient conditions. The present invention overcomes the above-enumerated disadvantages of the prior art by providing a chair having a thermoelectric cooler that selectively heats or cools the chair.

SUMMARY OF THE INVENTION

The present invention relates to a chair having both a heating and cooling means integral therewith. The device comprises a seat portion with a backrest portion vertically extending therefrom. The seat portion is superimposed on a plurality of support legs that suspend the chair above an underlying surface. Adjacent each of two sides of the seat portion is an armrest. Imbedded within both the backrest portion and the seat portion is a thermoelectric cooler for selectively generating or removing heat. The cooler is regulated with a control panel positioned on one of the armrests.

It is therefore an object of the present invention to provide a chair that can be selectively heated or cooled.

It is another object of the present invention to provide a chair that enhances the comfort of persons participating in certain outdoor activities.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
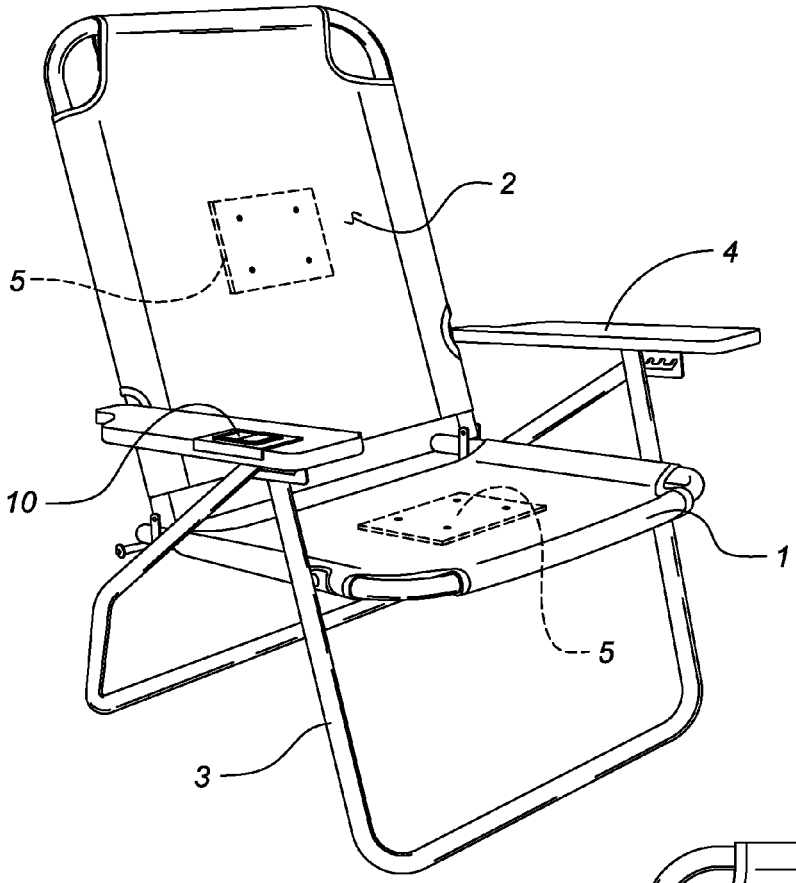
FIG. 1 is a perspective view of the chair according to the present invention.
Figure 2:
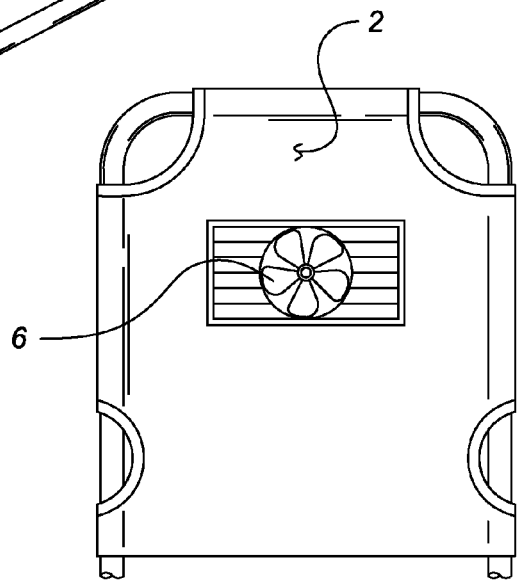
FIG. 2 is a rear, plan view of the chair backrest.

The present invention relates to a chair having a heating and cooling means integral therewith. The device comprises a seat portion 1 with a backrest portion 2 vertically extending therefrom. The seat portion is superimposed on a plurality of support legs 3 that suspend the chair above an underlying surface. Adjacent each of two sides of the seat portion is an armrest 4. Preferably, the seat portion, the backrest portion and the support legs are collapsible in a conventional fashion.

Imbedded within both the backrest portion and the seat portion is a thermoelectric cooler 5 for selectively generating or removing heat. The thermoelectric cooler is conventional and includes a pair of plates, each constructed with a dissimilar metal. The plates are interconnected with a semiconductor material whereby an electric current applied to the two dissimilar materials causes a temperature differential. Depending upon the direction of the current, the temperature differential results in either heating or cooling. The thermoelectric cooler also includes a cooling fan 6 for removing excess heat therefrom.

The cooler is regulated with a control panel 10 conveniently mounted on the chair, i.e., on one of the armrests. For example, the control panel may include a selector switch that allows the user to select either a cooling or a heating mode by reversing the directional current flow. A rotary dial allows a user to select a relative temperature, i.e., cooler, warmer, etc.

The above-described device is not limited to the exact details of construction and enumeration of parts provided herein. For example, the thermoelectric cooler and accompanying control switches may be packaged as a separate kit for after-market installation within an existing chair. Additionally, the chair could be a stool without the backrest, or virtually any type of conventional indoor or outdoor chair or seat having either a seat portion, a backrest portion, or both. The size, shape and materials of construction of the various components can also be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The invention claimed is:

1. A temperature adjustable chair comprising:

a seat portion;

a first temperature adjustment means for selectively heating and cooling said seat portion according to an ambient temperature, said first temperature adjustment means including a thermoelectric cooler imbedded within said seat portion for selectively generating and removing heat, said thermoelectric cooler including a pair of plates, each of said plates constructed with a dissimilar metal, said plates interconnected with a semiconductor material whereby an electric current applied to the plates causes a temperature differential, and wherein said current traveling in a first direction results in cooling, and wherein said current traveling in a second direction, opposite to said first direction, results in heating.

2. The temperature adjustable chair according to claim 1 further comprising a backrest portion vertically extending from said seat portion.

3. The temperature adjustable chair according to claim 2 further comprising a second temperature adjustment means for selectively heating and cooling said backrest portion according to an ambient temperature.

4. The temperature adjustable chair according to claim 3 further comprising a first relative temperature adjustment means for varying an output intensity of said first temperature adjustment means.

5. The temperature adjustable chair according to claim 4 further comprising a second relative temperature adjustment means for varying an output intensity of said second temperature adjustment means.

6. The temperature adjustable chair according to claim 2 wherein said second temperature adjustment means comprises a thermoelectric cooler embedded within said backrest portion for selectively generating and removing heat.

7. The temperature adjustable chair according to claim 6 wherein said thermoelectric cooler includes a pair of plates, each of said plates constructed with a dissimilar metal, said plates interconnected with a semiconductor material whereby an electric current applied to the plates causes a temperature differential, and wherein said current traveling in a first direction results in cooling, and wherein said current traveling in a second direction, opposite to said first direction, results in heating.

8. The temperature adjustable chair according to claim 6 wherein said thermoelectric cooler also includes a cooling fan for removing excess heat therefrom.

9. The temperature adjustable chair according to claim 6 wherein said thermoelectric cooler is regulated with a control panel, said control panel including a selector switch that allows the user to select either of a cooling mode and a heating mode.

10. The temperature adjustable chair according to claim 1 wherein said seat portion is superimposed on a plurality of support legs for suspending the chair above an underlying surface.

11. The temperature adjustable chair according to claim 1 wherein said thermoelectric cooler also includes a cooling fan for removing excess heat therefrom.

12. The temperature adjustable chair according to claim 1 wherein said thermoelectric cooler is regulated with a control panel, said control panel including a selector switch that allows the user to select either of a cooling mode and a heating mode.

* * * * *